United States Patent [19]

von Mangoldt

[11] 3,949,268

[45] Apr. 6, 1976

[54] BALLAST UNIT FOR GAS DISCHARGE LAMPS SUCH AS FLUORESCENT TUBES OR THE LIKE

[76] Inventor: Burkhard von Mangoldt, Eupener Str. 217, 51 Aachen, Germany

[22] Filed: Mar. 14, 1974

[21] Appl. No.: 451,162

Related U.S. Application Data

[63] Continuation of Ser. No. 225,251, Feb. 10, 1972, abandoned.

[30] Foreign Application Priority Data

Feb. 11, 1971 Germany ..... 2106576
Aug. 30, 1971 Germany ..... 2143268

[52] U.S. Cl. ..... 315/239; 315/DIG. 5; 315/254; 315/257

[51] Int. Cl.[2] ..... H05B 41/16

[58] Field of Search ..... 315/257, 188, 126, 239, 315/94, DIG. 5, 254

[56] References Cited

UNITED STATES PATENTS

| | | | |
|---|---|---|---|
| 2,510,209 | 6/1950 | Bridges | 315/257 |
| 2,629,072 | 2/1953 | Nathanson | 315/188 |
| 3,287,599 | 11/1966 | Feinberg et al. | 315/126 |
| 3,295,015 | 12/1966 | Rosiak | 315/239 |

*Primary Examiner*—Palmer C. Demeo
*Attorney, Agent, or Firm*—Burns, Doane, Swecker & Mathis

[57] ABSTRACT

The disclosure relates to a ballast unit for gas discharge lamps, particularly fluorescent lamps, by which a substantially constant burning current is supplied to the lamp. The ballast unit includes a transformer mounted on a core having a defined air gap. The transformer is provided with a leakage inductance having a value resulting in a voltage drop of between approximately 15 and 30 percent of an input voltage applied thereto. One or more capacitors are connected in series with the transformer output supply to the lamp. The one or more capacitors provide a capacitance in series with the lamp substantially equal to the ratio of the burning current to the angular frequency of the input voltage multiplied by the secondary no-load voltage supplied to the secondary circuit.

12 Claims, 17 Drawing Figures

BALLAST UNIT FOR GAS DISCHARGE LAMPS SUCH AS FLUORESCENT TUBES OR THE LIKE

BACKGROUND OF THE INVENTION

This is a continuation of application Ser. No. 225,251, filed Feb. 10, 1972 and now abandoned.

The present invention relates to a ballast unit for gas discharge lamps such as fluorescent tubes or the like, having a high-voltage transformer adapted to operate in the saturation range and having a primary and secondary winding surrounding a common core and a stray inductance which is provided between the primary and secondary winding.

Ballast units of this kind are required, on the one hand to supply the necessary striking voltage for gas discharge lamps, such as fluorescent tubes, of the kind used in particular for display purposes, and on the other hand, — after striking has taken place — to ensure the necessary limitation of the burning current of the gas discharge lamps to a defined nominal current which is substantially independent of the burning voltage which fluctuates in accordance with the impedance of the gas discharge lamps or in accordance with external disturbing effects. The relatively high striking voltage of, for example, 1000 V, is produced to this end by means of a transformer while current is limited by means of resistors, which, because of the small magnitude of the losses achieved thereby, are preferably constructed as inductive or capacitative reactances. The said reactances must be constructed so that the vectorial impedance value thereof may vary relative to the burning voltage applied to the connected gas discharge lamps, and preferably also vary relative to fluctuations of the input voltage which supplies the ballast unit, so that the burning current is maintained substantially constant despite such voltage fluctuations and so that the gas discharge lamp is able to operate constantly at the intended nominal parameters.

Leakage reactance transformers have been used inter alia as variable reactances to ensure that the burning current is maintained at a constant value under varying burning voltages in addition to providing current limitation, such leakage reactance transformers being suitable for adjusting the burning current basically to the desired nominal value but involving substantial expense and the risk of disturbing hum noises. The power factor is low so that additional compensating capacitors are required which in turn must be blocked against audio frequencies in supply networks incorporating ripple control systems. Ballast units operating with leakage reactance transformers therefore represent only a relatively unsatisfactory solution to the problems which arise in the operation of gas discharge tubes.

Accordingly, use has also been made of magnetic current stabilizers in which use is made of a core-saturated transformer preceded by a stray inductance, produced directly on the transformer by means of a leakage core, to function as inductive reactance on the input side, or being preceded by a separate inductor while a resonant capacitor is connected on the output side in parallel to a winding. Such a voltage stabilizer, for example, as disclosed in the German Auslegeschrift No. 1,246,121 permitted stabilization of the burning current to a defined value in the same manner as the previously mentioned adjustable leakage reactance transformers but also involve a relatively large expense for the inductance on the input side and on the other hand produces output voltages or output currents with a substantial harmonics content, in particular powerful resonance peaks, which have a very detrimental effect on the plant, in particular, on the gas discharge lamps connected thereto, with regard to their insulation stability as well as with regard to their working life.

The object of the present invention is therefore the provision of a ballast unit which ensures substantial stabilization of a defined nominal burning current independently of changes of the burning voltage, preferably also independently of the primary voltage which feeds the ballast unit but with a lesser expense than hitherto and without producing hum noises or harmonics, in particular those having dangerous resonance peaks.

To solve this problem, a ballast unit of the kind mentioned heretofore is characterized according to the invention by the combination of the following features: (a) the total value of leakage inductance is such that the voltage drop across the inductance amounts to between approximately 15 and 30 percent of the primary input voltage; (b) the core of magnetic material is provided with a defined air gap; (c) at least one series capacitor, co-defining the nominal burning current, having a capacitance which is substantially equal to the ratio of burning current to angular frequency multiplied by the secondary no-load voltage being connected into the secondary load circuit.

Combination of these three features provides a ballast unit in the desired manner which actually substantially satisfies the electrical requirements despite the slight expense. Actual current limitation is ensured by an appropriately dimensioned series capacitor while the leakage inductance proportion on the one hand and as provided by the invention, and the air gap on the other hand provide matching with respect to magnitude and phase of the no-load current of the ballast unit and the total primary current taken thereby and in relation to the burning current so that the burning current, representing the vectorial difference of primary current and no-load current, remains substantially constant despite burning voltage fluctuations. Furthermore, the leakage inductance ensures that a power factor is maintained, deviating only slightly from unity even for a wide voltage fluctuation range. Furthermore, the air gap may be constructed so that its width is adjustable to enable the amount of no-load current to be reduced by reducing the air gap width or for the no-load current to be increased by increasing the air gap width so that precision matching to the desired burning current magnitude may be achieved in addition to a change of power factor.

Furthermore, a ballast unit is to be provided by means of which constant currents of different magnitude may be produced. Means are also to be provided by the parallel operation of at least two secondary windings for any desired increase of the no-load voltage limited by regulations and without exceeding the voltage limits thus defined for each winding.

In the secondary circuit at least two series capacitors are preferably connected in parallel to each other, the three connections of said capacitors providing optionally with the free end of the secondary winding at least two constant-current circuits, connected in parallel to each other, or one constant-current circuit, the operating current of which corresponds to the sum of the individual constant-current circuits.

According to a further feature of the invention the secondary winding may be divided in accordance with the number of series capacitors and each of the secondary winding sections may be connected to a series capacitor.

The ballast unit according to the invention offers the advantage that a single unit provides constant-current circuits of different current magnitude without the need for adjustment at the installation site, in particular two constant-current circuits, each of 40 mA or one constant-current circuit rated at 80 mA.

In this way, it is possible for the ballast unit according to the invention to be efficiently manufactured and stored since only one construction is required for the two principal kinds of ballast units and from which a constant-current of the desired magnitude may be tapped off. In the embodiment in which the secondary winding is divided, a number of constant-current circuits will be obtained in accordance with the division each of which in separate operation and given a serial connection provide a defined constant current and in parallel connection provide an operating current which corresponds to the sum of the individual constant currents.

The capacitance of the series capacitors may also be variable in order to adjust the available constant-current circuits with respect to the current magnitude.

At least one recess for connecting, monitoring and safety devices such as terminals, switches and fuses is preferably formed in the housing of the ballast unit, such devices being furthermore provided with a covering, removal of which results in interruption of the primary circuit to provide a space-saving and safe construction of the ballast unit according to the invention. In order to dispense with an additional protective housing in a ballast unit all of whose structural elements are combined into a unified block by enclosure with a casting resin sheath, the said block is preferably provided with mounting fittings so that the ballast unit may be directly mounted on the intended support and requires no additional protective housing.

In order to permit uniform illumination of the transparent surfaces also by suitable reflection, the side of the ballast unit nearest to the fluorescent tube may have substantially chamfered or rounded edges or may be constructed in trapezoidal or semi-circular form. A further improvement of illumination may be achieved if the exterior of the ballast unit is provided with a reflective covering.

Embodiments of the invention together with further features thereof will be explained hereinbelow by reference to the accompanying drawing in which.

Figure 1:
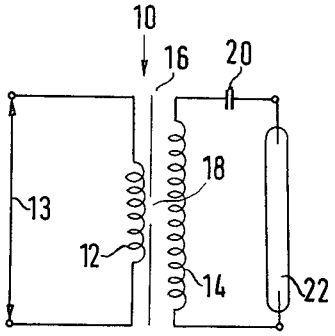
FIG. 1 shows in diagrammatic form the circuit of the ballast unit according to the invention.
Figure 7A:
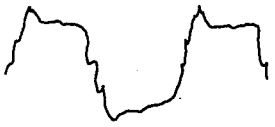
Figure 7B:
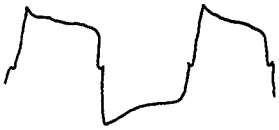
Figure 8A:
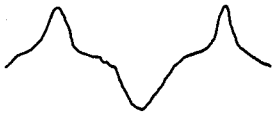
Figure 8B:
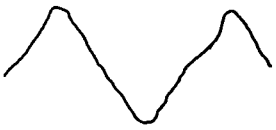
Figure 9:
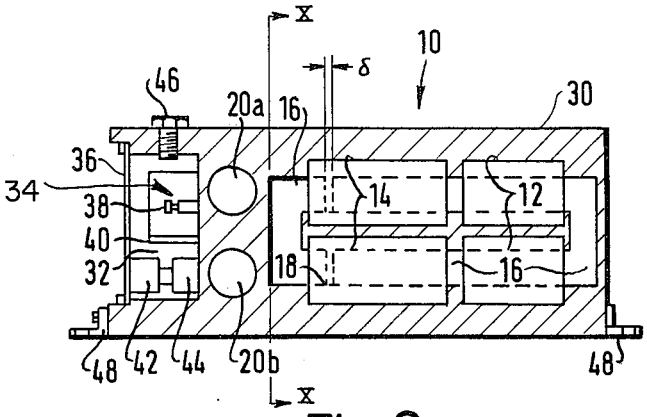
Figure 10:
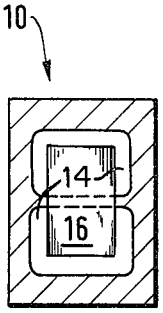
Figure 11:
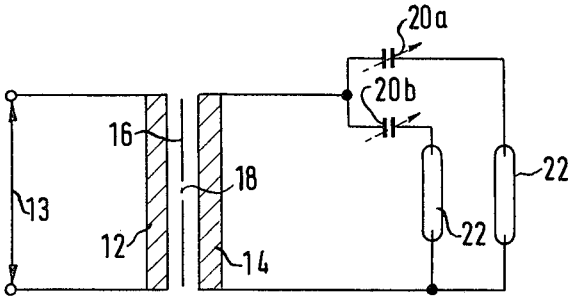
Figure 12:
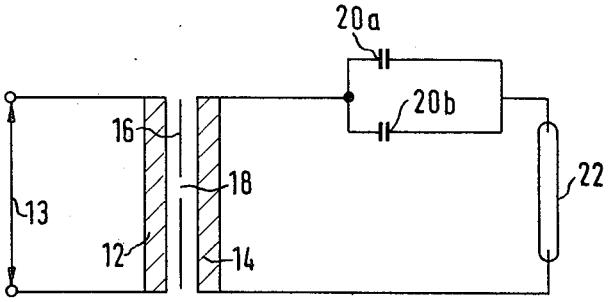
Figure 13:
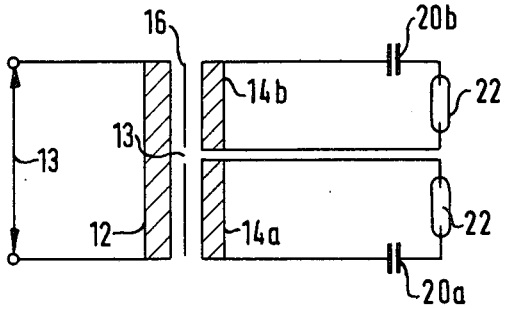
Figure 14:
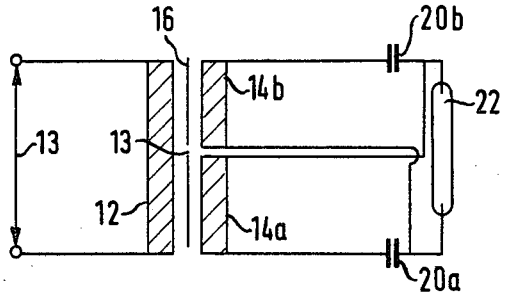
Figure 15:
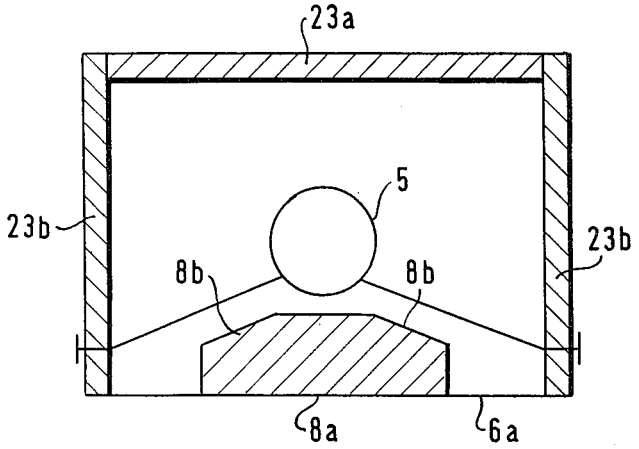

FIG. 7*a* shows the change of burning voltage of the ballast unit according to the invention with respect to time compared to FIG. 7*b* which shows the change of burning current with respect to time for a leakage reactance transformer according to the prior art;

FIG. 8*a* shows the change of burning currents with respect to time of a ballast unit according to the invention compared with FIG. 8*b* the change of burning current with respect to time of a leakage reactance transformer according to the prior art;

FIG. 9 is a longitudinal section through a ballast unit constructed in accordance with the principles described in connection with FIGS. 1–3;

FIG. 10 is a cross-section through the embodiment of FIG. 1 in the zone of the transformer;

FIG. 11 shows in schematic form the circuit layout of the ballast unit when used for two constant-current circuits;

FIG. 12 shows the circuit layout according to FIG. 11 if the ballast unit is employed for a constant-current circuit having an operating current which corresponds to the sum of the two constant-current circuits;

FIG. 13 shows in schematic form the circuit layout of the ballast unit when used with a divided secondary winding and two constant-current circuits and FIG. 14 shows the circuit layout according to FIG. 13 if the ballast unit is employed for a constant-current circuit having an operating current corresponding to the sum of the two parallel-connected constant-current circuits;

FIG. 15 is a cross-section through a modification of an inscription or sign character according to the invention at the position at which the ballast unit is mounted.

FIG. 1 in general shows the circuit layout of a ballast unit according to the invention, referred to in its entirety by the numeral 10. The said ballast unit has a primary winding 12 and a secondary winding 14 coupled to the said primary winding 12 via the core 16. The primary winding 12 is fed by the mains voltage 13 while the secondary winding 14 is connected through a series capacitor 20 to a gas discharge lamp 22 which may, for example, be constructed as fluorescent tube and whose burning voltage may be 1000 V. The interruption of the core 16 indicates an air gap 18 which is provided in accordance with the invention.

Figure 2:
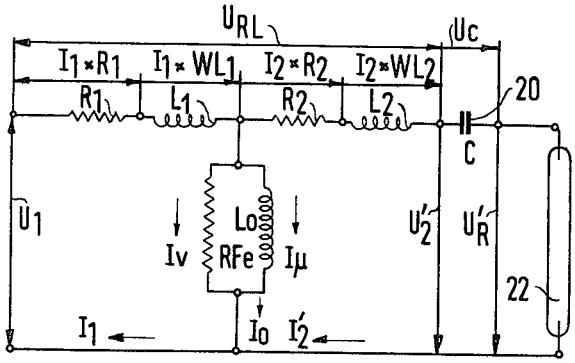
FIG. 2 is an equivalent circuit diagram for the circuit of FIG. 1.

FIG. 2 is a substitution circuit diagram of the circuit layout according to FIG. 1. In this illustration the primary circuit is sub-divided into the non-reactive resistance part $R_1$ and the primary leakage inductance part $L_1$ the secondary circuit on the other hand being subdivided into the non-reactive resistance part $R_2$ and the secondary leakage inductance part $L_2$, all components being connected in series. The primary inductance $L_0$ of the transformer is connected between the junction of the series circuit comprising $R_1$ and $L_1$ on the one hand and $R_2$ and $L_2$ on the other hand and the return conductor, the iron resistance $R_{Fe}$, defining the loss current $I_V$ being connected in parallel thereto. The end of the secondary therefor leakage inductance $L_2$ which is at a distance from the resistance $R_2$, is connected as in FIG. 1 through the capacitor 20 to the gas discharge lamp 22. The primary forward and return conductors of the transformer carry the current $I_1$ while the secondary forward and return conductors carry the current $I'_2$, the apostrophy (′) indicating that the secondary current is reduced on the primary side. The current $I'_2$ also corresponds to the burning current of the gas discharge lamp 22. Accordingly, the voltage $I_1 \cdot R_1$ is dropped across the non-reactive resistance part $R_1$, the voltage $I_1 \cdot WL_1$ being dropped across the primary leakage inductance, the voltage $I'_2 \cdot R_2$ being dropped across the secondary non-reactive resistance part $R_2$ and the voltage $I'_2 \cdot WL_2$ being dropped across the secondary stray or leakage inductance. The sum of the aforementioned four voltage drops represent the voltage drop $U_{RL}$. The voltage $U_C = I'_2 \cdot WC$ is dropped across the capacitor 20 and the voltage $U'_R$ is dropped across the gas discharge lamp 22. The capacitor voltage $U'_C$ and the burning voltage $U'_R$ together form the secondary output voltage $U'_2$ of the transformer. The parallel circuit comprising the primary transformer inductance $L_0$ and the non-reactive resistance part $R_{Fe}$ gives rise to the no-load current $I_0$ which is divided, as regards the non-reactive resistance part $R_{Fe}$, into the loss current $I_V$ and, as regards the inductance $L_o$ into the magnetizing current $I_u$.

Figure 3:
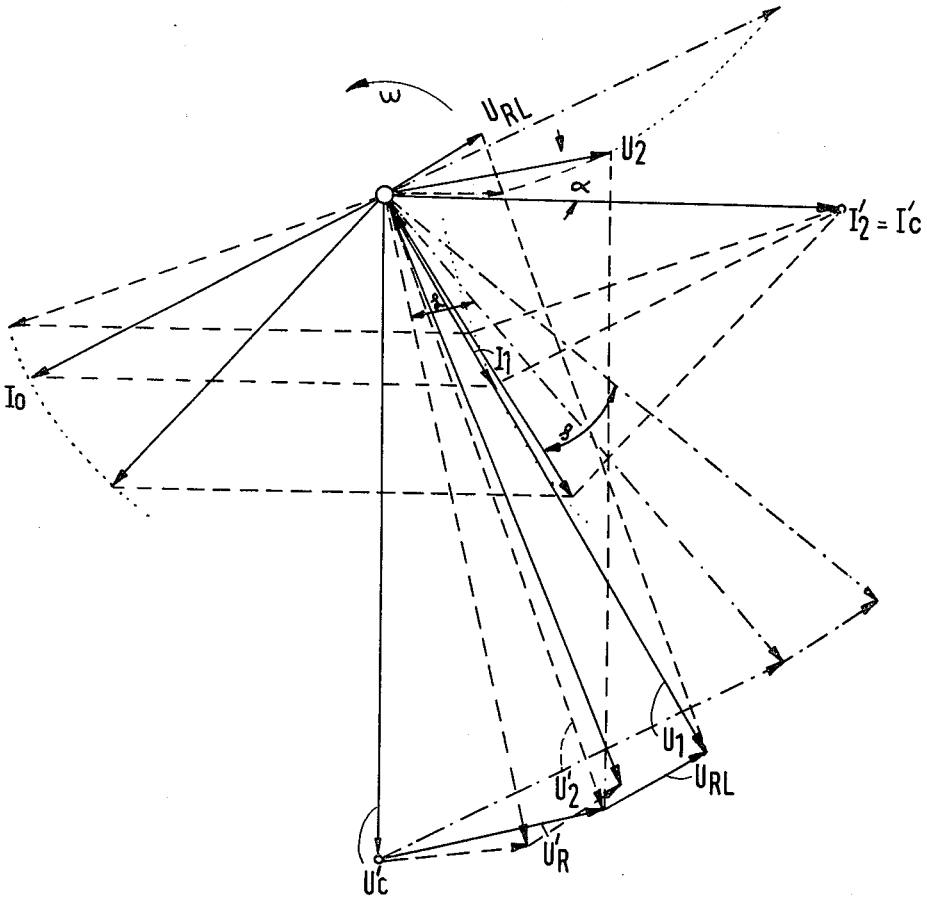
FIG. 3 is a vector diagram showing in detail the phase related voltage-current conditions for the substitution circuit diagram of FIG. 2 under conditions of load with different gas discharge lamps.

FIG. 3 shows the different voltage and current values of the substitution circuit diagram of FIG. 2 in the form of vectors in their respective phase for three burning voltages $U'_R$ of three different magnitudes. The burning current vector $I'_2$, disposed on the real axis and also representing the capacitor current $I'_C$, is used as reference value. The said burning current lags behind a burning voltage $U'_R$ by an angle, the magnitude of which is not constant but depends on the prevailing ratio of voltage drop across the electrodes of the gas discharge lamp (active component) to the voltage drop across the struck gas discharge gap (reactive component). Accordingly, magnitude and phase of the burning voltage vary in accordance with the kind of connected gas discharge lamp (in particular length of a fluorescent tube) along a parabolic polar curve as plotted in FIG. 3 in the form of a dotted line.

The capacitor voltage $U'_C$ lags behind the current $I'_C$ by 90° through the capacitor 20 which is assumed to be loss-free. The said voltage is practically constant since neither the capacitance of the capacitor 20 nor the burning current flowing through the capacitor change substantially, the said burning current changing insubstantially because of the inventive control process which will be explained hereinbelow. The sum of the vectors $U'_R$ and $U'_C$ provide the secondary output voltage of the transformer $U'_2$ and the addition of the said output voltage $U'_2$ and the earlier mentioned voltage drop $U_{RL}$ across the primary and secondary resistance parts together with the primary and secondary leakage inductance provide the primary input voltage $U_1$. As far as can be defined by measurement, the magnitude of $U_{RL}$ is substantially constant with respect to magnitude and phase for all practical operating states so that it may be regarded as a fixed value for the present consideration.

The magnetic inductance (not plotted in this case) lags behind the secondary output voltage $U'_2$ by 90°, the no-load current $I_0$ in the embodiment described herein leading the said inductance by a relatively small, uniform angle of approximately 6°. An angle, which remains uniform at approximately 103° is therefore also obtained between $U_1$ and $I_0$ owing to the constancy of $U_{RL}$. The vectorial sum of $I_0$ and $I_2$ is equal to the current $I_1$ obtained from the mains and being precisely in phase with the primary input voltage $U_1$ in the diagram of FIG. 3 since the burning voltage $U'_R$ is based on conditions for which the power factor is equal to unity.

The broken or dash-dot lines indicate relationships which occur if a burning voltage $U'_{R2}$ or $U'_{R3}$ is dropped across the gas discharge lamp 22, said voltage beng smaller or greater than the burning voltage $U'_R$. Owing to the inventive construction of the ballast unit 10 the burning current $I'_2$ remains substantially constant in the desired manner even for these smaller or larger burning voltages. If the burning voltage corresponds to the voltage vector $U'_{R2}$, a secondary output voltage will be obtained which lags more substantially behind the burning current $I'_2$ in the manner illustrated in the diagram than the secondary output voltage with respect to the burning voltage value $U'_R$. Due to the constancy of $U_{RL}$ the primary input voltage in this case also lags behind the burning current $I'_2$ to a greater extent than is the case for the burning voltage $U'_R$ and the no-load current vector $I_0$ is rotated clockwise by a corresponding amount because of the angle of 103° between $U_1$ and the no-load current $I_0$, which angle may be regarded as constant. The amount of $I_0$, the magnitude of which is defined in first place by the primary inductance $L_0$ and therefore also by the air gap 18, practically does not alter since the magnitude of $L_0$ is defined by the selected construction parameters.

The phase and magnitude of the current $I_1$ obtained from the mains varies in accordance with the polar curve, shown as dotted line in the fourth quadrant, as was found by measurement, due to the leakage inductance proportion provided in accordance with the invention and because of the operation in the saturation range. Due to this special change of $I_0$ on the one hand and $I_1$ on the other hand, it follows that the secondary burning current $I'_2$ remains constant as vectorial difference between the no-load current and the primary current in the manner illustrated in the diagram of FIG. 3 and irrespective of changes of the burning voltage.

While the power factor is unity for the burning voltage $U'_R$, a capacitative power factor will be obtained for lower burning voltages and and inductive power factor will be obtained for higher burning voltages, also as indicated in the diagram of FIG. 3. However, as may also be seen by reference to the diagram the power factor value remains large enough to ensure a favorable mode of operation without the need for additional compensating measures.

Figure 4:
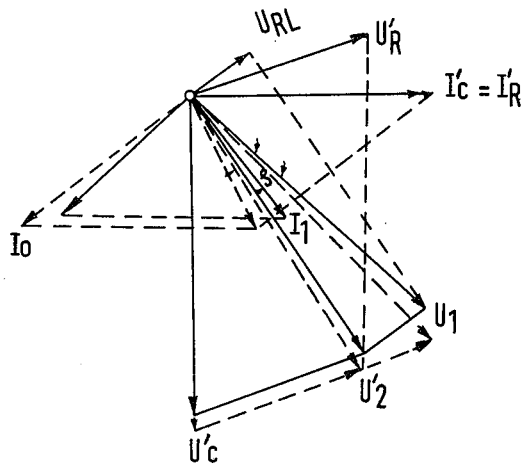
FIG. 4 is a vector diagram similar to FIG. 3 showing the change of voltage-current conditions in the event of an increase of the primary voltage on the input side by, for example, 10 percent.

FIG. 4 shows a further vector diagram corresponding to the diagram of FIG. 3 but illustrating changes of conditions which are obtained with an assumed increase of the mains voltage by 10 percent. The vectors shown in solid lines correspond to the condition with the assumed mains voltage while the vectors shown in broken lines illustrate the state corresponding to an increase of mains voltage by the aforementioned value of 10 percent. In the ensuing consideration it may first be assumed that the burning current has increased by 5 percent. Owing to the dropping characteristic the tube burning voltage $U'_R$ remains practically unchanged. The value of $U'_C$ is also necessarily increased by 5 percent. The voltage $U'_2$ is slightly rotated in the clockwise direction and also increases by approximately 5 percent. Since the ballast unit operates in the core saturation range, the value of the current vector $I_0$ is increasingly enlarged accompanied by rotation so that the input current is rotated in the clockwise direction and is furthermore slightly reduced owing to the fixed relationship which exists between the output current, input current and no-load current. Due to the increase and change of direction of the currents $I_1$ or $I_2$, the voltage vector $U_{RL}$ is also slightly rotated in the clockwise direction because the mains voltage increases by approximately 10 percent. Accordingly, the changes of $I'_R$ and $U_1$ vary approximately as 1 : 2 or, expressed in other words, a change of mains voltage by 10 percent results in a change of the burning current in the same sense but amounting to approximately 5 percent.

Figure 5:
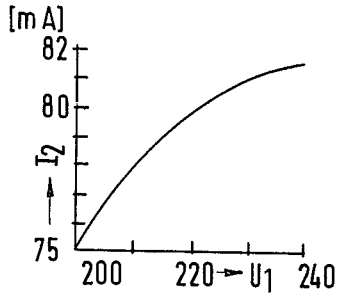
FIG. 5 shows a diagram, generally referring to the change of a defined burning current relative to the change of the primary voltage on the input side.

FIG. 5 shows this non-linear relationship between burning current and mains voltage. The degree of independence of burning current from the mains voltage is completely sufficient for practical purposes. Known ballast units, such as the known leakage inductance transformers on the other hand have an almost square-law relationship between burning current and mains voltage and therefore function in a substantially more sensitive manner.

Figure 6:
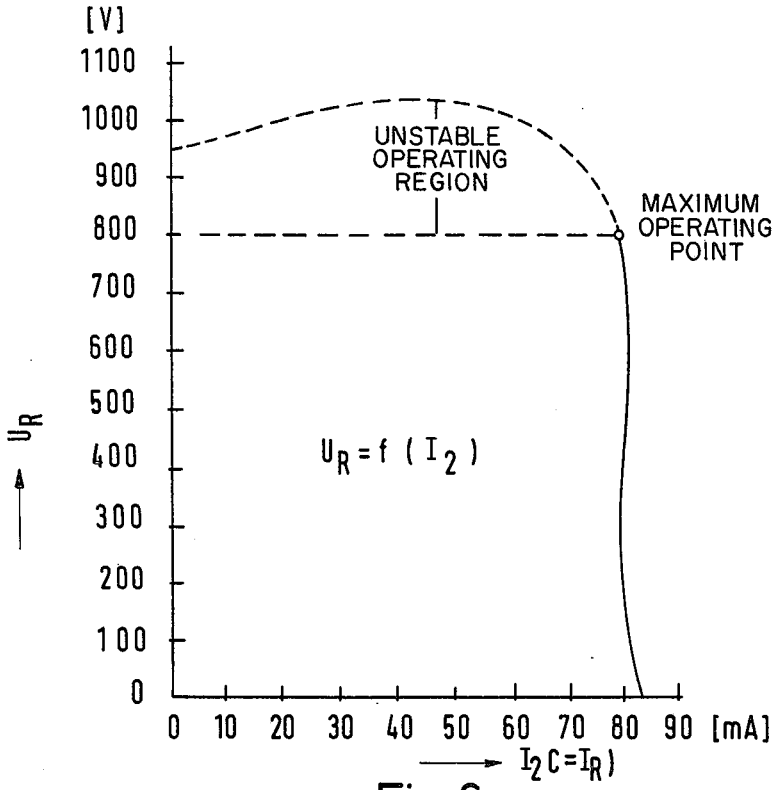
FIG. 6 shows a diagram showing the interrelationship between burning voltage or burning current of a ballast unit according to the invention for an operating voltage of 220 V, 50 Hz and a nominal secondary voltage of 1000 V and a nominal secondary current of 80 mA.

The diagram of FIG. 6 shows the variation of burning current for the entire theoretical possible burning voltage range. The section of the characteristic located below the plotted maximum operating point shows only a slight dependence of burning current on burning voltage and the burning current magnitude remains practically constant even under short circuit conditions, this feature providing the advantage that the windings need be designed only for this maximum value. The change of current between short circuit conditions and maximum burning voltage amounts to less than 3.5 percent and accordingly the ballast unit according to the invention shows its superiority with respect to other construction utilizing a series capacitor and in which current changes of up to 10% are not uncommon.

The air gap 18, being an important feature of the invention ensures that the burning voltage and burning current remain substantially free of harmonics and in particular of resonance peaks. FIGS. 7*a* and 7*b* or 8*a* and 8*b* respectively indicate the characteristics of burning voltage or burning current for the ballast unit according to the invention compared with a conventional leakage inductance transformer. The burning voltage supplied by the ballast unit according to the invention or the burning current supplied thereby have practically no resonance peaks of this kind predominantly present to some extent in ballast units according to the prior art, so that the ballast unit according to the invention is very advantageous even in this respect.

FIG. 9 is a side view of a physical embodiment of a ballast unit according to the invention. FIG. 10 is a cross-section through FIG. 9 along line X—X. A primary winding 12 and a secondary winding 14 are disposed serially on the two limbs or legs of an elongated core 16. The air gap 18 of adjustable width is disposed in the zone of the secondary winding 14. The length of the winding space of the core 16 is approximately 5½ times its width in view of the desired magnitude of leakage inductance. Two series capacitors 20, which may be connected in balance with the gas discharge lamp or may also be connected directly in series in the burning current circuit, are disposed in front of the core 16. The capacitors 20 may be variable as is illustrated in phantom in FIG. 11 and as was previously described. The individual components are combined into a structural unit by means of a box-shaped casting resin jacket 30. The end of the casting resin jacket 30 disposed near the series capacitors 20 is provided with a recess 32 having disposed therein connecting elements 34 for the ballast unit.

In the illustrated embodiment the ballast unit 10 is provided with a primary winding 12 and a secondary winding 14 coupled with the formal winding through a core 16. The primary winding 12 is fed from a mains voltage 13 while the secondary winding 14 is connected to a gas discharge lamp 22, constructed as a fluorescent tube, through one or two series capacitors 20*a*, 20*b*. An air gap 18 is provided by an interruption of the core 16.

All parts of the ballast unit 10 described hereinbefore are combined into the smallest possible space and are encapsulated in block form in a casting resin jacket 30. In order to provide better space utilization the core 16 is constructed in elongated form; the primary and secondary windings 12 and 14 are divided, their half windings being disposed on the limbs of the core 16. The two series capacitors 20*a*, 20*b* are disposed between the end face of the transformer and a recess 32 provided in the casting resin jacket 30. The said recess 32, provided on the end face, accommodates connecting, monitoring and safety devices. The recess 32 is provided with a cover 36 which interrupts the primary current on being removed.

To this end, the terminals for the mains voltage 13 are combined with an isolator switch base 44, an isolator switch top 42 with an isolating blade being mounted on the cover 36. Removal of the cover 36 forcibly interrupts the mains supply and the transformer is rendered dead. A connecting lead is introduced into the recess 32 at the top of the casting resin jacket by means of a screwed terminal gland 46. The recess 32 also accommodates the terminals 38 for the high voltage, said terminals being covered by bulkheads 40 with respect to each other and with respect to the remaining terminal chamber. Two mounting brackets 48 are attached to the casting resin jacket 30 to enable the ballast unit 10 to be mounted thus dispensing with the need for an additional housing for mounting the said ballast unit 10.

The provision of two series capacitors 20*a* and 20*b*, connected in parallel to each other into the secondary circuit, provides the means for utilizing either two constant-current circuits connected in parallel to each other or one constant-current circuit the operating current of which corresponds to the sum of the individual constant-current circuits. When using the ballast unit 10 according to FIG. 11, two constant-current circuits are used to operate in parallel and whose currents are practically constant and substantially unaffected by the connected load. In the circuit system according to FIG. 12 the same ballast unit is employed for providing one constant-current circuit the operating current of which corresponds to the sum of the individual constant-current circuits. While each of the two gas discharge lamps 22 are fed with 40 mA according to a numerical example according to FIG. 11, the current flowing through the gas discharge lamp 22 according to FIG. 12 amounts to 80 mA.

The ballast unit according to FIG. 13 utilizes a secondary winding, sub-divided into two secondary winding sections 14*a* and 14*b*, each, together with their associated series capacitor 20*a* and 20*b* form a separate constant-current circuit, for example for 40 mA for the two gas discharge lamps 22. In the event of parallel connection of the two constant-current circuits according to FIG. 14, a constant-current of 80 mA will flow through the gas discharge lamp 22.

The inscription or sign character illustrated in FIG. 15 comprises of a bottom plate 6a and a transparent front wall 23a and side walls 23b. The ballast unit 8a, disposed under the fluorescent tube 5, has chamfered edges 8b so that the lateral transparent wall surfaces 23b are also uniformly illuminated. In the box-shaped embodiment of the inscription in which the side walls are constructed of opaque material, this construction of the ballast unit provides for a more uniform illumination of the transparent front wall 23 due to better reflection and in which the surface of the ballast unit 8a may also be provided with a reflecting stratum.

What is claimed is:

1. A ballast unit for supplying a burning voltage and a substantially constant burning current to a secondary circuit including a gas discharge lamp, said ballast unit comprising:

a core of magnetic material having a defined air gap therein;

transformer windings carried by said core, said transformer windings including a primary and secondary winding both surrounding said core, said windings and said core with said defined air gap together forming a transformer, the total value of leakage inductance of said transformer being such that with an input voltage applied to said primary winding, the voltage drop across the leakage inductance is between approximately 15 and 30 percent of said input voltage; and, at least one capacitor connected in series between said secondary winding and said gas discharge lamp, said at least one capacitor having a capacitance substantially equal to the ratio of the burning current of the gas discharge lamp to the product of the angular frequency of the input voltage multiplied by a secondary no-load voltage supplied to the secondary circuit, said transformer having said leakage inductance and said capacitor having said capacitance being cooperable to define means automatically operable to supply said burning current to said gas discharge lamp at a substantially constant value substantially independently of fluctuations in said burning voltage.

2. A ballast unit according to claim 1 wherein the air gap is disposed in the zone of the secondary winding.

3. A ballast unit according to claim 1 wherein the core is constructed in elongated, rectangular form and has a winding space intermediate two generally parallel legs thereof, the length of the winding space being at least 5½ times its width.

4. A ballast unit according to claim 3, wherein the primary and secondary windings are disposed on the same leg of the core in serial disposition.

5. A ballast unit according to claim 1 wherein all components are combined into a unified block by enclosure through a casting resin jacket and the block is provided with one or more externally accessible recesses for accommodating connecting elements.

6. A ballast unit according to claim 1 wherein one side of each of at least two capacitors is connected to one end of said secondary winding with the free ends of said capacitors being adapted for connection into the secondary circuit, the free ends of said capacitors together with the free end of the secondary winding providing at least two constant-current circuits connected in parallel to each other.

7. A ballast unit according to claim 6, wherein the secondary winding is divided into separate sections in accordance with the number of capacitors and each of the secondary winding sections is connected to a different one of said capacitors.

8. A ballast unit according to claim 7 wherein the capacitance of the capacitors is variable.

9. A ballast unit according to claim 8 wherein said transformer is enclosed by a housing and wherein at least one recess for connecting and safety devices is formed in the housing of the ballast unit.

10. A ballast unit according to claim 9 wherein the recess is provided with a cover, the removal of which results in interruption of the primary circuit.

11. A ballast unit according to claim 10 in which all components are combined into a unified casting resin jacket which forms said housing, the housing being provided with mounting brackets at each end thereof.

12. A ballast unit for a gas discharge lamp comprising:

first and second input terminals for receiving an a.c. input voltage from an input voltage source;

first and second output terminals for connecting said ballast unit to said gas discharge lamp and for supplying an output voltage thereto; and, means connected between said input and output terminals for supplying a burning current of a substantially constant value to said gas discharge lamp connected to said output terminals in response to said input voltage, said burning current being automatically maintained at said substantially constant value substantially independently of fluctuations in the burning voltage across said gas discharge lamp, said means comprising:

a transformer including a core of magnetic material having a defined air gap therein and a primary and a secondary winding both surrounding said core, said primary winding being operatively connected to said input terminals to receive said input voltage and one side of said secondary winding being operatively connected to one of said output terminals, said transformer having a total value of leakage inductance such that between 15 and 30 percent of the input voltage applied to the ballast unit is dropped across said leakage inductance; and, at least one capacitor connected in series between the other side of said secondary winding and the other of said output terminals, said at least one capacitor having a capacitance substantially equal to said value of the burning current of the gas discharge lamp divided by the product of the angular frequency of said input voltage and said output voltage supplied at said output terminals with no-load connected to said output terminals.

* * * * *